US006895781B2

(12) United States Patent
Dobmeier et al.

(10) Patent No.: US 6,895,781 B2
(45) Date of Patent: May 24, 2005

(54) MULTIPLE REFRIGERANT CIRCUITS WITH SINGLE ECONOMIZER HEAT EXCHANGER

(75) Inventors: Thomas J. Dobmeier, Phoenix, NY (US); Michael F. Taras, Fayetteville, NY (US); Howard H. Fraser, Jr., New Woodstock, NY (US)

(73) Assignee: Carrier Corporation, Syracuse, NY (US)

( * ) Notice: Subject to any disclaimer, the term of this patent is extended or adjusted under 35 U.S.C. 154(b) by 88 days.

(21) Appl. No.: 10/694,283

(22) Filed: Oct. 27, 2003

(65) Prior Publication Data

US 2005/0086975 A1 Apr. 28, 2005

(51) Int. Cl.[7] ..... F25B 41/00
(52) U.S. Cl. ..... 62/513; 62/175; 62/199
(58) Field of Search ..... 62/513, 113, 175, 62/196.4, 199

(56) References Cited

U.S. PATENT DOCUMENTS 4,876,859 A 10/1989 Kitamoto
5,095,712 A * 3/1992 Narreau ..... 62/113
5,875,637 A 3/1999 Paetow
6,047,556 A 4/2000 Lifson
6,206,652 B1 3/2001 Caillat
6,694,750 B1 * 2/2004 Lifson et al. ..... 62/113
6,758,054 B2 * 7/2004 Zheng et al. ..... 62/199

OTHER PUBLICATIONS

Systems & Advanced Technologies Engineering S.r.I., publication entitled "Compsys—Dynamic Simulation of Gas Compression Plants", dated Jun. 12, 2002.
Copeland Europe publication entitled "Refrigeration Scroll for Parallel Applications" dated Feb. 26, 2002.

* cited by examiner

*Primary Examiner*—Marc Norman
(74) *Attorney, Agent, or Firm*—Carlson, Gaskey & Olds

(57) ABSTRACT

A multiple circuit refrigerant system includes a single economizer heat exchanger utilized for each of at least two circuits. The use of the single economizer heat exchanger reduces the cost of adding an economizer cycle, and further reduces other associated costs. Additionally, heat exchanger and overall system performance is enhanced further. Embodiments show the inclusion of two, three and four circuits, although greater numbers may also benefit form this invention.

10 Claims, 1 Drawing Sheet

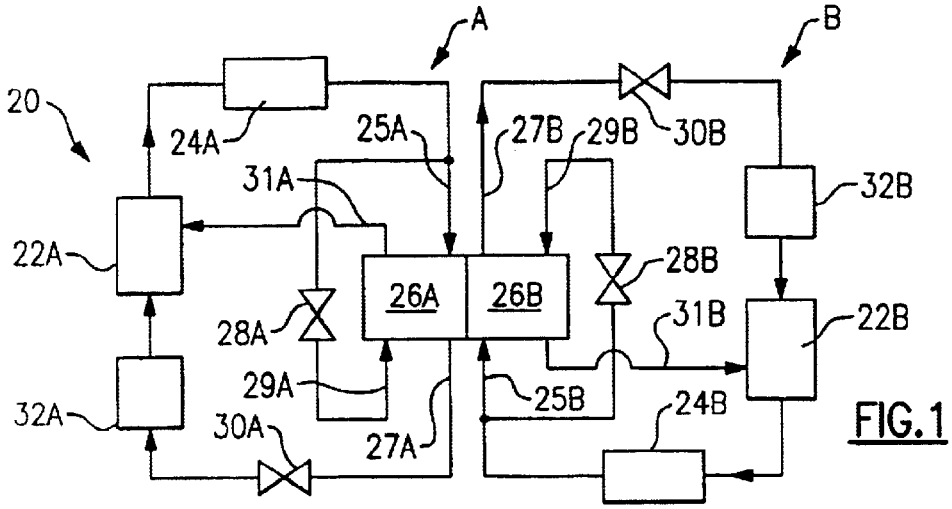
FIG.1
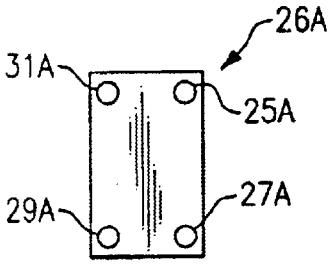
FIG.2A
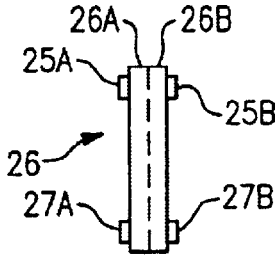
FIG.2B
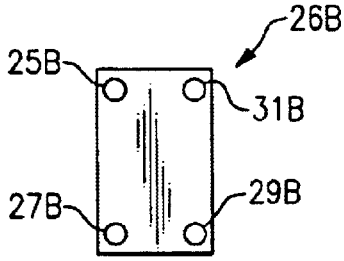
FIG.2C
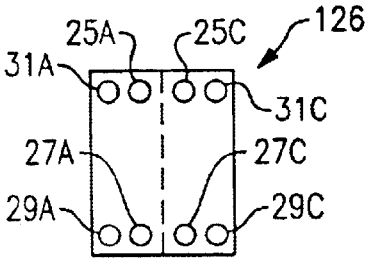
FIG.3A
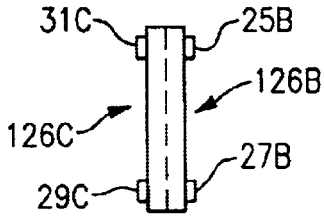
FIG.3B
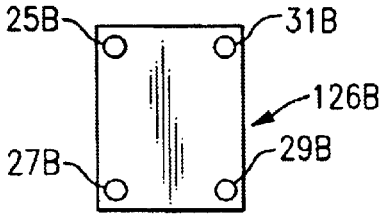
FIG.3C
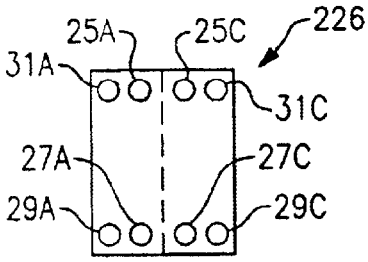
FIG.4A
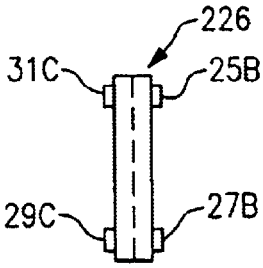
FIG.4B
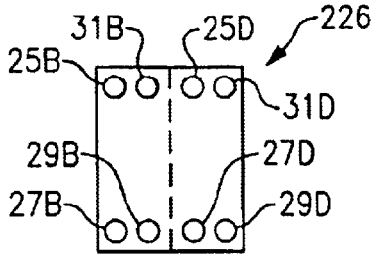
FIG.4C
FIG.5
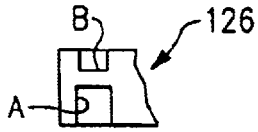

MULTIPLE REFRIGERANT CIRCUITS WITH SINGLE ECONOMIZER HEAT EXCHANGER

BACKGROUND OF THE INVENTION

This application relates to a refrigerant system having multiple circuits, and a single economizer heat exchanger utilized by at least two circuits.

Refrigerant cycles are utilized to provide cooling and/or heating, refrigeration, etc. As known, in a refrigerant cycle, a refrigerant is compressed at a compressor and then moved to a condenser. From the condenser, the refrigerant passes to an expansion device, and then to an evaporator. From the evaporator, the refrigerant returns to the compressor.

With varying challenges upon a refrigerant cycle, modifications such as the use of multiple circuits have been developed. A multiple circuit system may include two complete and separate cycles of each of the basic components described above. The cycles may be used alternatively or in combination dependent upon the load on the system.

One other aspect that has been recently developed and added to modem refrigerant cycles is an economizer cycle. In an economizer cycle, a portion of the refrigerant downstream of the condenser is tapped and passed through an expansion device. The tapped refrigerant is cooled after having passes through its expansion device, and is then passed through an economizer heat exchanger. The main refrigerant flow downstream of the condenser also passes through the economizer heat exchanger, preferably in a counter-flow arrangement, and is cooled by the tapped refrigerant. This cooling brings the main flow to a somewhat lower temperature than it was previously achieved in the condenser, thus providing a higher cooling capacity when the main flow reaches the evaporator.

The use of an economizer cycle provides benefits that relate to enhanced performance in providing the highest cooling capacity and efficiency under high load conditions. However, in many applications, the addition of an economizer cycle is too expensive to justify its inclusion in a refrigerant cycle. The economizer cycle requires a good deal of additional plumbing, a separate additional heat exchanger, a separate additional expansion valve, piping to both control the tapped refrigerant, re-routing it back to the compressor after passing through the economizer heat exchanger, and modifications in the design of the economized compressors. Thus, while economizers have value in increasing efficiency, in many applications they are too expensive to be adopted. This is particularly true in the above-described multiple circuit systems where all of the additional costs would be multiplied by the number of circuits.

The present invention provides a unique way of lowering the cost of adding an economizer cycle to a multiple circuit refrigerant system as well as further enhancing system performance.

SUMMARY OF THE INVENTION

In a disclosed embodiment of this invention, a single heat exchanger unit is utilized as the economizer heat exchanger for a plurality of refrigerant circuits in a multiple circuit system. In particular, the single heat exchanger provides separate flow paths for both the tapped and main refrigerant flow for each of the plurality of multiple circuits, all within a single unit. Disclosed embodiments include two multiple circuit systems, three multiple circuit systems, and a four circuit system. Higher numbers would come within the scope of the invention.

In preferred embodiments, the single economizer heat exchanger includes back-to-back flow members guiding the various fluid paths.

When more than two circuits are utilized, there will be at least two separate flow passages on at least one side of the single economizer heat exchanger.

The present invention reduces the number of connections, bracketing, etc. that is required for multiple circuit refrigerant systems. Thus, the overall cost of providing economizer circuits in a multiple circuit system is reduced. Moreover, the cost of having separate economizer heat exchangers is, of course, reduced.

Further, if a single heat exchanger is utilized instead of multiple units for each system circuit, the heat exchanger and overall system performance can be enhanced. If an economizer heat exchanger is located in the outdoor section of the system, then it is exposed to the ambient air, which is hotter than the refrigerant flowing through the heat exchanger. In such a scenario, if the heat exchanger is not insulated (insulation represents an additional cost component), then part of its cooling capacity will be lost to the environment. A single heat exchanger unit will have less surface area exposed to the environment, reducing such heat flux loss. This thus improves the heat exchanger and overall system performance. If the economizer heat exchanger is placed in the indoor section of the unit, it is exposed to colder (than refrigerant flowing through the heat exchanger) indoor air. Hence, a portion of cooled air capacity will be wasted with the economizer heat exchanger refrigerant. Once again, having a single heat exchanger unit reduces the surface area exposed to cold indoor air, limiting cooling capacity loss and improving system performance.

These and other features of the present invention can be best understood from the following specification and drawings, the following of which is a brief description.

BRIEF DESCRIPTION OF THE DRAWINGS

FIG. 1 is a schematic view of a multiple circuit refrigerant system.

FIG. 2A shows a first embodiment heat exchanger.

FIG. 2B is a side view of the FIG. 2A embodiment.

FIG. 2C shows the reverse side of the FIG. 2A embodiment.

FIG. 3A shows yet another embodiment.

FIG. 3B is a side view of the FIG. 3A embodiment.

FIG. 3C is a rear view of the FIG. 3A embodiment.

FIG. 4A shows yet another embodiment.

FIG. 4B is a side view of the FIG. 4A embodiment.

FIG. 4C shows a reverse view of the FIG. 4A embodiment.

FIG. 5 shows a portion of the heat exchanger shown in FIG. 3C.

DETAILED DESCRIPTION OF THE PREFERRED EMBODIMENT

A multiple circuit refrigerant system 20 is illustrated in FIG. 1. As is known, a pair of compressors 22A and 22B are associated with individual circuits A and B. Separate condensers 24A and 24B receive refrigerant from the respective compressors 22A and 22B. From the condensers, the refrigerant passes to an economizer heat exchanger 26A and 26B.

As known, a main expansion device 30A and 30B is positioned downstream of the economizer heat exchanger 26A and 26B, and an evaporator 32A and 32B is downstream of the main expansion device 30A and 30B.

A main refrigerant path 27A and 27B passes refrigerant from the condensers into the economizer heat exchanger 26A and 26B. The refrigerant in the main refrigerant flow path 27A and 27B passes through the economizer heat exchanger, and continues to a downstream line 27A and 27B.

A tapped refrigerant is tapped through a tap line 29A and 29B from the main line 25A and 25B and passes through an economizer expansion device 28A and 28B. This refrigerant is tapped and passes through the economizer heat exchanger 26A and 26B, and then to a return line 31A and 31B back to the compressor 22A and 22B.

All of the system as described above is known. What is inventive is the use of a single unit as the combined economizer heat exchanger 26A and 26B for both of the circuits A and B.

FIG. 2A shows a first embodiment of the economizer heat exchanger, having the inlet for the main refrigerant flow path or a liquid refrigerant 25A, and an outlet 27A. Similarly, the tapped refrigerant passes into an inlet 29A and an outlet 31A. The flow passages within this heat exchanger 26A may be as known, and would typically include a number of channels and passages through which the refrigerants in the two separate flow paths come close to each other such that heat can be exchanged, and the flow in the main refrigerant flow line cooled.

As can be appreciated from FIG. 2B, the heat exchangers 26A and 26B may be back-to-back, with their various flow passages 25 A and B, 27 A and B, and 29 A and B and 31 A and B positioned to be spaced from each other. FIG. 3C shows the reverse side and shows that the heat exchanger 26B would closely resemble the heat exchanger 26A.

FIG. 3A shows another embodiment wherein there are three circuits to the refrigerant cycle. Here, a separate main flow path 25C and 27C receive the main flow of refrigerant, while a separate economizer tapped fluid 29C and 31C provide the tapped economizer fluid for the third circuit. FIG. 3B and FIG. 3C show the heat exchanger 126, as being similar to the FIG. 2A-C embodiments.

FIGS. 4A–4C show a four circuit system. Here, on the rear side, a fourth circuit 25D, 27D, 29D and 31D is also provided. It should be understood that in the FIG. 3 and FIG. 4 embodiments, a central separation wall preferably separates the A and C and B and D circuits.

The present invention further allows the provision of various controls to the amount of heat transfer such as by controlling the depth of channels, width of channels, number of passages, geometry inside the channels, etc. As an example, in the FIG. 3A embodiment, there is less cross-sectional space on the side of the heat exchanger 126 including both circuits A and C. The associated flow paths for the circuits A and C might have a greater depth than the flow paths associated with circuit B such that the lesser crosssectional area is compensated for. Of course, other dimensions of the flow paths can also be varied to achieve this compensation. Such controls, as mentioned above, can also be utilized, for example, when circuits of different capacities are employed in the system.

FIG. 5 shows one feature of the present invention, somewhat schematically. As can be appreciated by those of ordinary skill in this art, within the heat exchangers 26, 126 and 226, there are a number of flow lines for bringing the two flows into heat transfer contact. As mentioned, to provide the same amount of heat transfer surface area in the flow passages between, for example, the A and C circuits of FIG. 3A and the B circuit of FIG. 3C, the A and C circuits should have their passages be deeper, a greater number of passages, etc. FIG. 5 shows this schematically. As can be appreciated, a flow passage associated with circuit A is shown to be approximately twice as deep as a similar passage associated with the circuit B. Again, this is due to the fact that circuit B has an entire side, while circuit A would have only approximately half of its side. As mentioned, other ways of achieving this balance in heat transfer, such as adjusting the number of passages, internal geometry, etc. can be utilized. Moreover, this adjustment can also be utilized simply to have varying capacities to the several circuits. That is, if one of the circuits typically passes a greater amount of refrigerant than the other, it would be provided with a greater amount of heat transfer surface area.

However, the present invention provides the main benefit of reducing system cost for a multiple circuit refrigerant cycle system wherein an economizer cycle is incorporated. First, separate heat exchangers are not required, and thus separate brazing operations, etc. are not required. Second, the overall applied compressor cost is reduced in that separate brackets, etc. for two separate heat exchangers are not required, separate brazing, separate mounting, etc. are eliminated. Finally, the complexity of routing all of the required flow lines to each of several distinct economizer heat exchangers is reduced, and less space is required for a multiple circuit system.

Furthermore, the performance of the single economizer heat exchanger serving multiple circuit system as well as overall system performance are enhanced, since less amount of outside heat exchanger surface is exposed to hotter outdoor air or colder indoor air.

Although a preferred embodiment of this invention has been disclosed, a worker of ordinary skill in this art would recognize that certain modifications would come within the scope of this invention. For that reason, the following claims should be studied to determine the scope and content of this invention.

What is claimed is:

1. A multiple circuit refrigerant system comprising:

at least two separate refrigerant circuits, each of said two separate refrigerant circuits having a compressor, a condenser, an expansion device, an evaporator, and an economizer cycle, each of said economizer cycles including a tapped line for tapping a refrigerant from an outlet of said condenser, said tapped line passing through an economizer heat exchanger, and a main flow line from said condenser from which said tapped line is tapped also passing through said economizer heat exchanger, and said economizer heat exchangers for each of said plurality of refrigerant cycles being provided in a single unit.

2. A refrigerant cycle as set forth in claim 1, wherein said single economizer heat exchanger separates said tapped and main flow lines for each of said at least two refrigerant circuits.

3. A refrigerant cycle as set forth in claim 1, wherein said single economizer heat exchanger includes separate circuits on each of opposed faces of said single economizer heat exchanger.

4. A refrigerant cycle as set forth in claim 3, wherein there are at least three refrigerant circuits and there being at least two sets of said tapped and main flow lines on one of said faces of said single economizer heat exchanger.

5. A refrigerant cycle as set forth in claim 1, wherein said economizer heat exchanger has passages associated with each of said plurality of refrigerant cycles, and at least some of the passages having a distinct size.

6. A refrigerant cycle as set forth in claim 5, wherein a depth of said passages is different to account for a total area difference of said passages between said plurality of refrigerant cycles.

7. A multiple circuit refrigerant system comprising:

at least two separate refrigerant circuits, each of said two separate refrigerant circuits having a compressor, a condenser, an expansion device, an evaporator, and an economizer cycle, each of said economizer cycles including a tapped line for tapping a refrigerant from an outlet of said condenser, said tapped line passing through an economizer heat exchanger, and a main flow line from said condenser from which said tapped line is tapped also passing through said economizer heat exchanger; and said economizer heat exchangers for each of said plurality of refrigerant cycles being provided in a single unit, said single economizer heat exchanger separates said tapped and main flow lines for each of said at least two refrigerant circuits, and said single economizer heat exchanger includes separate circuits on each of opposed faces of said single economizer heat exchanger.

8. A multiple circuit refrigerant system as set forth in claim 7, wherein flow passages within said heat exchanger associated with said separate circuits have a distinct size.

9. A multiple circuit refrigerant system as set forth in claim 8, wherein flow passages associated with circuits on opposed faces of said heat exchanger have a different depth.

10. A multiple circuit refrigerant system as set forth in claim 9, wherein said economizer heat exchanger having two separate circuits on one of said faces, and another circuit on an opposed face, with said flow passages associated with said first face having greater size than said circuit associated with said opposed face, to accommodate for the fact of two circuits on said one face.

* * * * *